US005426484A

United States Patent [19]

Kawamoto et al.

[11] Patent Number: 5,426,484

[45] Date of Patent: Jun. 20, 1995

[54] CONVEYOR HOUSING HAVING AN OPENING WHICH CAN BE RENDERED IN ACCESSIBLE BY A TONER HOUSING

[75] Inventors: Motozi Kawamoto; Atsuo Ohmura; Susumu Owada, all of Hachioji, Japan

[73] Assignee: Konica Corporation, Japan

[21] Appl. No.: 61,220

[22] Filed: May 13, 1993

[30] Foreign Application Priority Data

May 21, 1992 [JP] Japan ..... 4-128794

[51] Int. Cl.[6] ..... G03G 15/00

[52] U.S. Cl. ..... 355/200; 222/DIG. 1; 355/260

[58] Field of Search ..... 355/260, 210, 245, 200; 118/653, 658; 222/DIG. 1

[56] References Cited

U.S. PATENT DOCUMENTS

| | | | |
|---|---|---|---|
| 4,870,463 | 9/1989 | Miyoshi et al. | 355/260 X |
| 4,913,087 | 4/1990 | Saita et al. | 118/653 |
| 4,977,429 | 12/1990 | Tani et al. | 355/260 |
| 4,982,242 | 1/1991 | Ishii et al. | 355/260 X |
| 5,075,724 | 12/1991 | Wada et al. | 355/260 X |
| 5,121,165 | 6/1992 | Yoshida et al. | 355/260 |
| 5,175,587 | 12/1992 | Kato et al. | 222/DIG. 1 X |
| 5,260,748 | 11/1993 | Kahle | 355/260 X |
| 5,266,998 | 11/1993 | Lee | 355/245 X |

OTHER PUBLICATIONS

Patent Abstracts of Japan, vol. 11 No. 162 (P-579) (2609) JPA-61-294,468; Dec. 25, 1986.

Patent Abstracts of Japan, vol. 11 No. 170 (P-581) (2617) Jun. 2, 1987 JPA-62-977; Jan. 6, 1987.

*Primary Examiner*—A. T. Grimley

*Assistant Examiner*—Shuk Y. Lee

*Attorney, Agent, or Firm*—Jordan B. Bierman; Bierman and Muserlian

[57] ABSTRACT

Developing apparatus includes a developing housing and a toner supply housing which is pivotal to a first position on which the toner supply housing comes in engagement with the developing housing so that an opening of the developing housing is covered so as not to be accessible from the outside or to a second position on which the toner supply housing is spaced from the developing housing so that the opening is made to be able to be accessible from the outside.

9 Claims, 5 Drawing Sheets

CONVEYOR HOUSING HAVING AN OPENING WHICH CAN BE RENDERED IN ACCESSIBLE BY A TONER HOUSING

BACKGROUND OF THE INVENTION

The present invention relates to a developing device comprising a developing unit that develops an electrostatic latent image formed on an image carrier through an electrophotographic recording system or an electrostatic recording system to be a visual image using developer and a toner supply unit that supplies toner to the developing unit.

In general, in an electrostatic image forming apparatus such as an electrophotographic copying machine or the like, an electrostatic latent image on a charge-carrier (a photoreceptor drum and others) is developed to be a visual toner image in a developing device, and then the visual toner image is transferred onto a recording sheet to be fused thereon so that a copy image may be formed.

Heretofore, as a developing method for an electrostatic latent image formed on a photoreceptor drum, there has been used widely a magnetic brush type developing device employing a two-component developer consisting mixedly of toner and magnetic carrier or a single-component developer. In the magnetic brush type developing device, a developing roller composed of a cylinder-shaped non-magnetic developing sleeve and a plurality of permanent magnets provided inside the developing sleeve is positioned to be away from an image carrier with a fixed gap between them, and developers adhering magnetically to the circumferential surface of the developing sleeve are conveyed through the rotation of the developing sleeve to a developing area which faces the image carrier for the development of the electrostatic latent image.

In the developing device wherein the two-component developer mentioned above is used, when copying is repeated, toners in the developing device are consumed. Accordingly, when toners equivalent in quantity to the consumption amount are not supplied and thereby the mixture ratio of toners to carriers (toner concentration) is not kept constant, copies having appropriate density can not be obtained. Therefore, the developing device is constituted so that the mixture ratio of toners to carriers in the developing device may be detected and thereby toners may drop to be supplied automatically by a toner supply unit.

On the other hand, developers contained in the developing device, after being used in copying for the number of times, cause a copied image to be deteriorated in image quality because of deterioration in performance of the developers caused by fatigue of carriers therein and by mixing of foreign materials such as paper dust and others. Therefore, when conducting a regular maintenance after making copies in predetermined quantity (for example, 10,000–30,000 copies), or when problems happen on the developer for some reasons, the developer is required to be replaced completely by putting fresh two-component developer in the developing device after discharging the total amount of the developer contained in the developing device.

Incidentally, single-component developer is also replaced in the similar manner.

When the electrostatic image forming apparatus is shipped from a factory, or when it is transported over the long distance, the apparatus is shipped or transported with no developers in the developing device, and developers are filled in the developing device after the image forming apparatus has been installed.

In general, when the developers are put in or replaced completely, fresh developers are poured through an opening formed by a cover on the top of the developing device. When pouring the developers, a part of them tend to flow out or scatter over the outskirts of the opening, resulting in troublesome cleaning thereof.

Since the opening is in the vicinity of the photoreceptor drum, in particular, care must be taken for the scattering of or contamination by the developers.

Further, since the space above the developing device interferes with an optical path through which the image light flux from an exposure unit of a copying machine passes to form an image on the photoreceptor drum, it is not possible to provide a hopper-shaped developer-pouring inlet on the cover of the developing device. Accordingly, it has been compelled to pour developers by dismounting a toner supply unit adjoining the developing device and thereby causing the opening to be exposed.

SUMMARY OF THE INVENTION

An object of the invention is to provide a developing device wherein developers are prevented from flowing out or from scattering when pouring fresh developers newly or when pouring fresh developers for replacement thereof into the developing device, and thereby maintenance job can be conducted easily, quickly and surely.

The object of the invention mentioned above is attained by a developing device comprising a developing unit that is composed of developer carrier having therein a magnetic roll of multiple magnets, a brush-height-regulating member that regulates the height of developer brush on the developer carrier and an agitating member that agitates the developer for mixing and a toner supply unit that supplies toner to the developing device, wherein an interlocking member is provided on each of a main body of the developing unit and that of the toner supply unit, and the toner supply unit is supported by the interlocking members so that the toner supply unit can revolve around the main body of the developing unit, thus, developer-pouring inlet on the developing unit can be opened when the toner supply unit is revolved with the interlocking member as a center.

DETAILED DESCRIPTION OF THE PREFERRED EMBODIMENT

Figure 1:
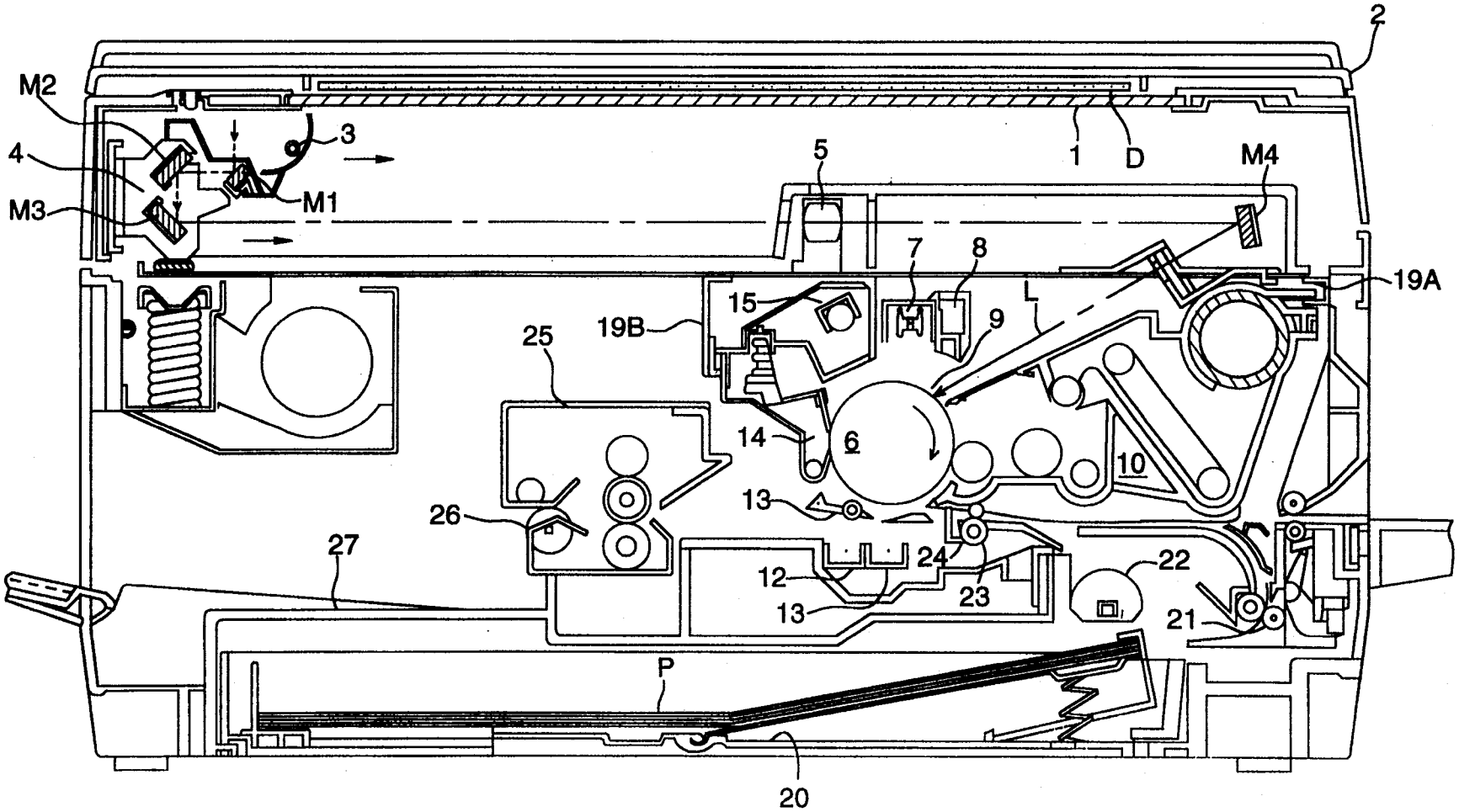
FIG. 1 is a general structural diagram of a copying machine equipped with a developing device of the invention.

FIG. 1 is a general structural diagram of an electrophotographic copying machine equipped with a developing device of the invention. An outline of the structure and function of the electrophotographic copying machine will be explained as follows, referring to the diagrams.

On the top of a main body of the copying machine, there is provided platen glass 1. When a switch to start copying is operated after document D is set on the surface of the platen glass 1 and is covered by a platen cover with pressure, light source 3 for exposure scans the document D for exposure thereof in a relative manner. Image light from the document D is converged by photographing lens 5 through moving mirror M1 that is united with the light source 3 and through moving mirrors M2 and M3 mounted on carriage 4 that travels simultaneously and relatively, and thereby is focused on the surface of photoreceptor drum 6 that is an image carrier to be an image further through fixed mirror M4.

The photoreceptor drum 6 is composed of a metal cylinder that is grounded and a photoconductive layer made of selenium, OPC or the like formed on the outer circumferential surface of the metal cylinder, and it is rotated in the arrowed (clockwise) direction being linked to the scanning for exposure mentioned above.

Around the photoreceptor drum 6, there are provided, in succession, charging electrode 7, charge-elimination. LED 8, exposure/image-forming unit 9, developing unit 10, transfer electrode 11, separation electrode 12, separation claw 13, cleaning unit 14 and remaining-image-eliminating (pre-charging exposure) unit 15.

With regard to the photoreceptor drum 6, the photoconductive layer thereon mentioned above is uniformly charged to be positive, for example, by the charging electrode 7 on which DC high voltage is impressed, before the image light is focused to be an image. When the photoconductive layer that is under the condition mentioned above receives the image light from the document D, the conductivity of the light-receiving portion is enhanced and thereby electric charges on the portion flow to the metal cylinder, thus, the positive charges remain on the dark portion depending on the degree of brightness. Accordingly, an electrostatic latent image corresponding to an image on the document is formed on the photoconductive layer. Then, the electrostatic latent image on the photoreceptor drum 6 is subjected to development by means of the developing unit 10 to be a toner image that is a visual image.

The visual toner image on the photoreceptor drum 6 arrives at a transfer unit.

On the other hand, transfer sheet P loaded on sheet-feeding cassette 20 is transported through first sheet-feeding roller 21, second sheet-feeding roller 22 and a guide plate and then is stopped temporarily by third sheet-feeding roller 23 and stopper 24. After that, the transfer sheet P is further transported in synchronization with the rotation of the photoreceptor drum 6 to reach the circumference of the photoreceptor drum 6, and the toner image on the photoreceptor drum 6 is transferred onto the transfer sheet P at a transfer section. To be concrete, the transfer sheet P fed to the transfer section is brought into close contact with the surface of the photoreceptor drum 6 and is subjected to discharging by means of the transfer electrode 11 in the polarity opposite to that of the toner, thus, the toner image is transferred onto the transfer sheet P.

The transfer sheet P on which the toner image has been transferred is then separated from the surface of the photoreceptor drum 6 by means of the separation electrode 12 and the separation claw 13 and is further transported to arrive at fixing unit 25 where the transfer sheet P is subjected to heating and fixing by means of a heating roller. The transfer sheet P is then ejected by sheet-ejecting roller 26 to be delivered on delivery tray 27.

On the other hand, toner staying on the surface of the photoreceptor drum 6 from which the transfer sheet P has been separated is removed by the cleaning unit 14 and remaining electric charges on the surface of the photoreceptor drum 6 are further removed by the pre-charging exposure unit 15 so that the photoreceptor drum may return to its original state. After that, the processes identical to those stated above are repeated for the next image formation.

Figure 2:
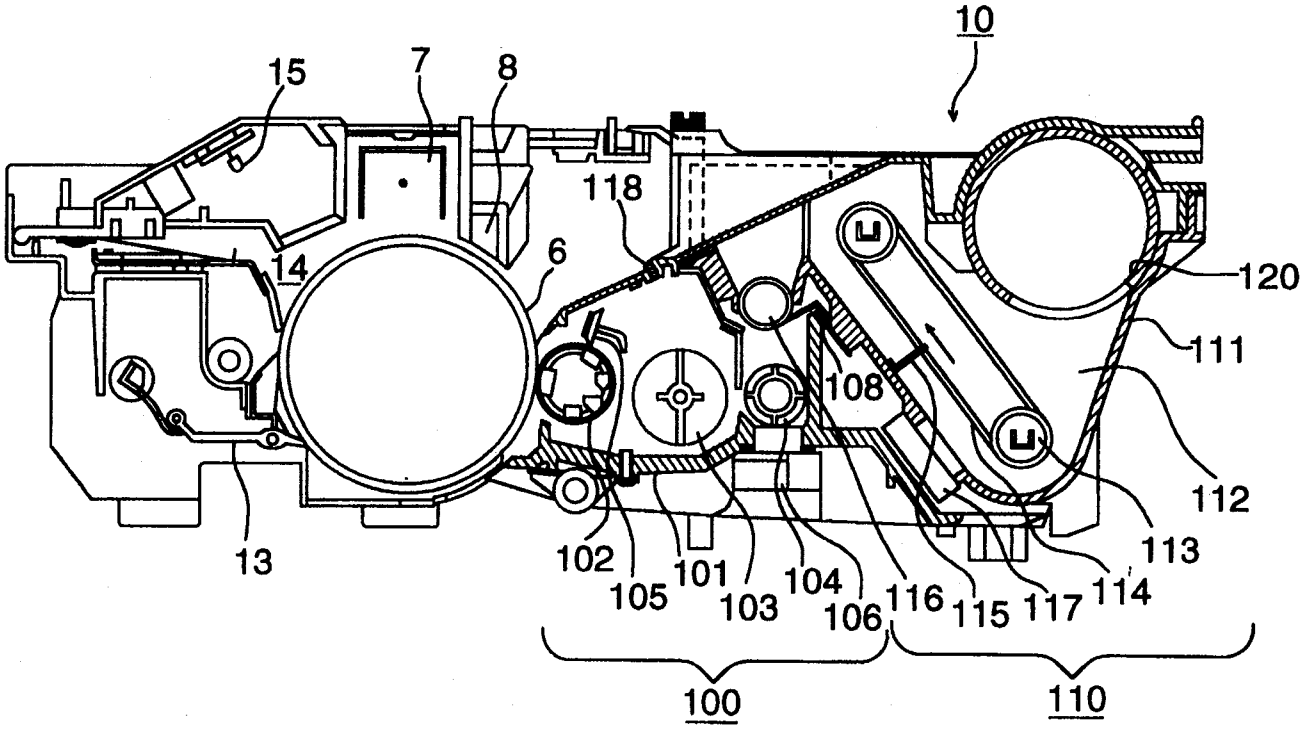
FIG. 2 is a sectional view of an image forming process unit of the copying machine mentioned above and FIG. 3 is a sectional view showing the opened developing device of the process unit mentioned above.

FIG. 2 is a sectional view of an image forming process unit in the copying machine mentioned above.

The developing device 10 mentioned above is roughly composed of developing unit 100 and toner supply unit 110.

Inside casing 101 of the developing unit 100, there are supported rotatably developing roller 102, main agitating member 103 and auxiliary agitating member 104. Further, brush-height-regulating plate 105 is provided above the developing roller 102 and toner concentration detection sensor 106 is provided below the auxiliary agitating member 104.

Inside casing 111 of the toner supply unit 110, there are provided cartridge-accepting chamber 112 into which or from which toner cartridge 120 containing toner to be supplied can be loaded or unloaded, a toner carrying-out means consisting of ladder wheel 113 that rakes out toner accumulated on the bottom of the casing 111 upward, ladder chain 114 and toner scraping-up member 115, toner supply screw 116 and remaining toner amount detection sensor 117.

Electric power transferred between a main body of the copying machine and developing device 10 such as high voltage current for bias to be impressed upon developing roller 102 in the course of developing and detection current of toner concentration detection sensor 106 as well as that of remaining toner amount detection sensor 117 are supplied from a power supply unit and a control unit.

When a portion where an electrostatic latent image is formed on the photoreceptor drum 6 mentioned above arrives at an approach position (developing area) on the developing roller 102 of the developing unit 100, toner is attracted by the electrostatic force to a charge-holding portion on the photoreceptor drum 6 to form an toner image.

When an amount of toner in the developing unit 100 is reduced and thereby the toner concentration is lowered after repetition of copying, the lowered toner concentration is detected by the toner concentration detection sensor 106. Then, toner to be supplied is carried out upward by the aforementioned toner carrying-out means in the toner supply unit 110 and is dropped from an opening of floor plate **111*d* on the casing 111 through the rotation of the toner supply screw 116. Then, the dropped toner is agitated and transported together with developer through the rotation of the auxiliary agitating member 104 of the developing unit 100 located below, and is further agitated and mixed by the main agitating member 103 so that one part thereof may be supplied to the developing roller 102 and the other part thereof may be supplied to the auxiliary agitating member 104**.

Figure 3:
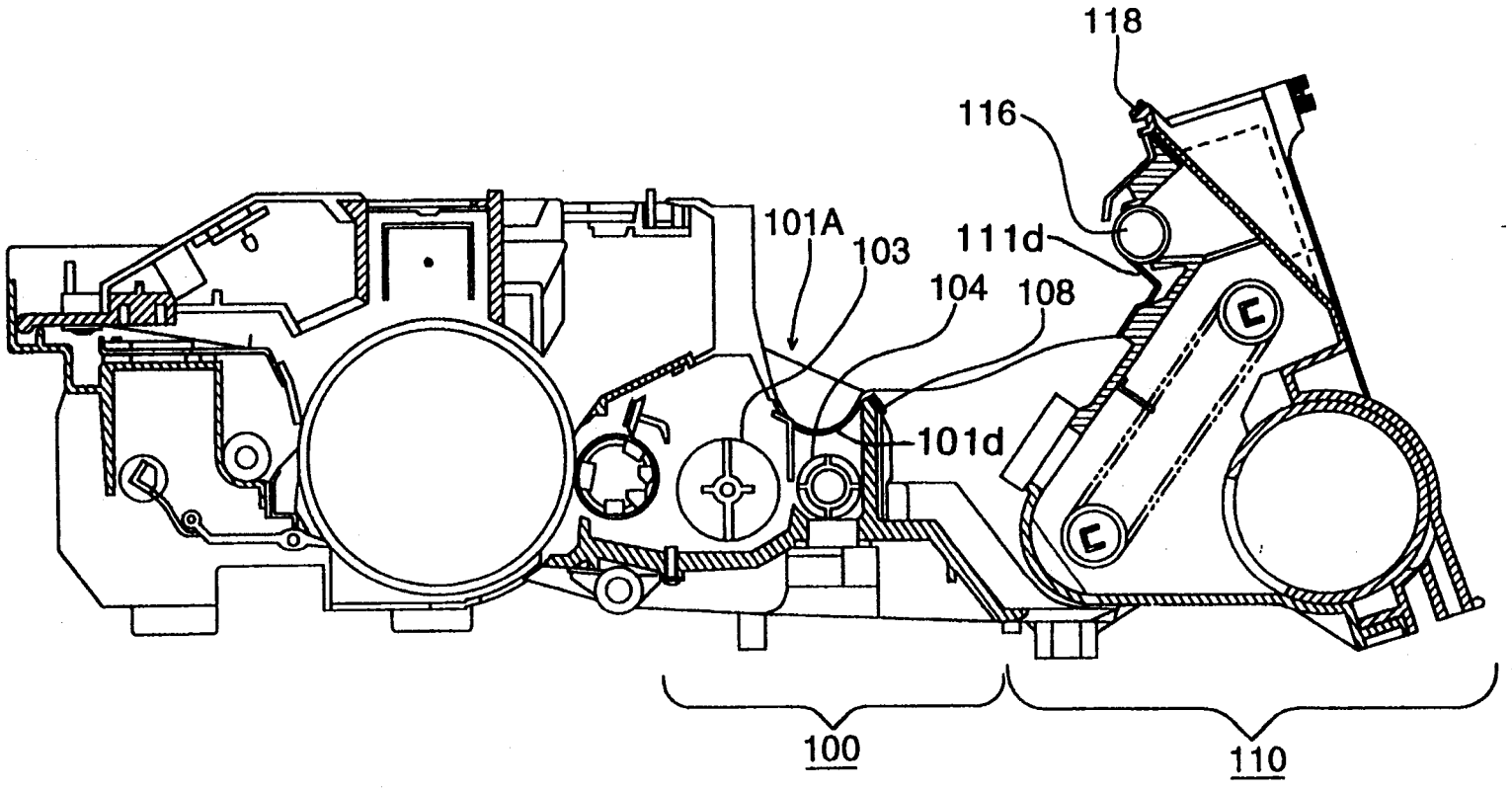

FIG. 3 is a sectional view showing the opened developing unit 100 in the invention.

In the developing device 10 of the invention, developer-pouring opening 101A is provided on ceiling plate **101*d* above the main agitating member 103 and at the upper portion of the casing 101 of the above-mentioned developing unit 100, and toner supply unit 110 is supported by interlocking members so that the toner supply unit 110 can revolve around the developing unit 100, thus, the opening 101A is opened when the toner supply unit 110** is revolved with the interlocking member as a center.

The periphery of the opening 101A is sealed with elastic pads 108 and 118 and when the copying machine is in use, the pads 108 and 118 cause the casings 101 and 111 to be in pressure contact so that the opening 101A can be kept to be airtight. To be concrete, the elastic pad 108 attached on a peripheral portion on one side of the opening 101A of the developing unit 100 is brought into pressure contact with casing 111 of the toner supply unit 110, while the elastic pad 118 glued on the end portion of the casing 111 of the toner supply unit 110 is brought into pressure contact with a peripheral portion on the other side of the opening 101A.

Under the condition that the opening 101A is sealed and shielded to be airtight (FIG. 1 and FIG. 2), flux of image light L coming through lens 5 and fixed mirror M4 passes through the space above the casings 101 and 111.

Figure 4:
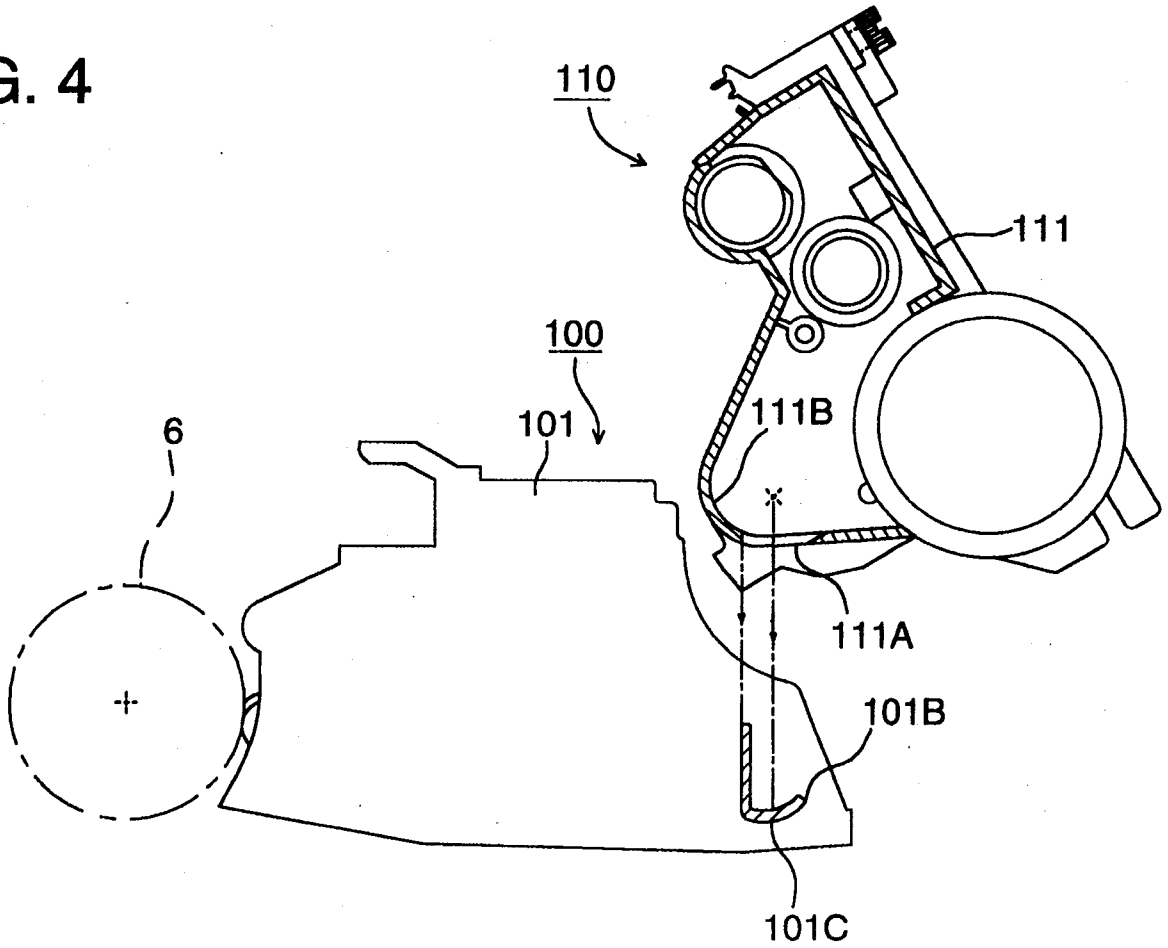
FIG. 4 is an exploded front view of the main portion of the toner supply unit in the developing device.

FIG. 4 is an exploded front view of the main portion of the developing unit 100 and toner supply unit 110. On both sides near the right side end of the casing 101 of the developing unit 100 in the figure, there are provided inverted-J-shaped guide walls 101B protruded inwardly respectively. The lower and outer wall surface of the guide wall 101B is formed to be circular arc convex curved surface 101C. On the other hand, on both outer sides at the bottom of the casing 111 of the toner supply unit 110, there are provided cutout 111A and inner circular arc concave curved surface 111B formed respectively. Both of the circular arc convex curved surface 101C and the concave curved surface 111B represent a circular arc curved surface having mostly the same radius. When the toner supply unit 110 is allowed to fall from upside in the arrowed direction while it is kept inclined, the cutout 111A on the casing 111 allows the above-mentioned guide wall 101B to pass through the cutout and thereby casings 101 and 111 respectively for the developing unit 100 and the toner supply unit 110 are linked rotatably to be free for opening or closing in the vicinity of the lower point.

Figure 5:
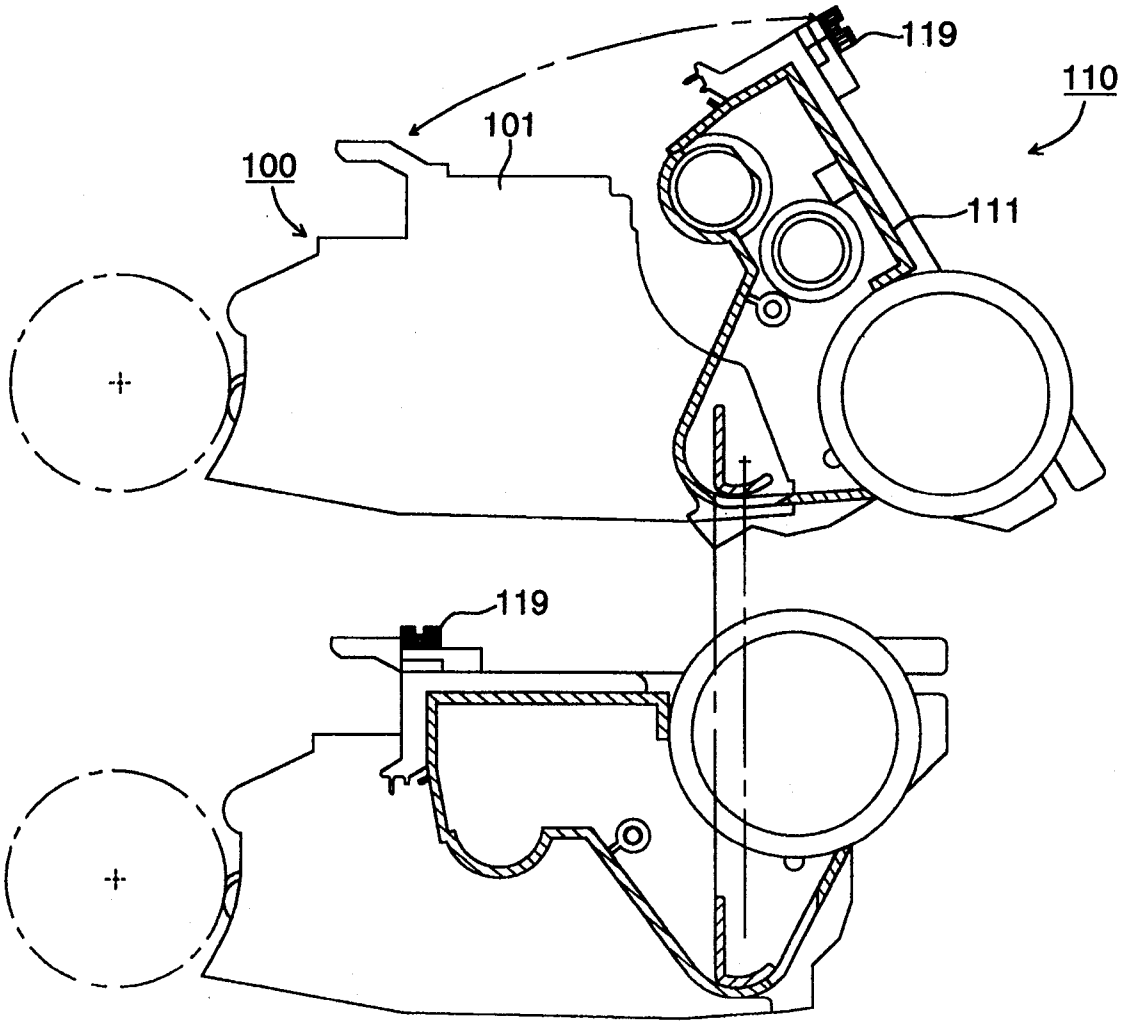
FIG. 5(A) and 5(B) are front views of the main portion of the developing device wherein the toner supply unit is combined with the developing unit to be opened or closed.

FIG. 5 (A) is a front view wherein the toner supply unit 110 is inclined by loosening clamping screw 119 and thereby the opening 101A is opened. Under this condition, developer is poured. FIG. 5 (B) represents the condition wherein the toner supply unit 110 is swung to close the opening and the clamping screw 119 is tightened so that the toner supply unit may be united to the developing unit 100 and the opening 101A is sealed hermetically.

Under the condition mentioned above, the opening 101A on the casing 101 is closed by being pressed and sealed by the casing 111 of the toner supply unit 110 and by elastic pads 108 and 118. Further, under the condition, the flux of image light L passes through the space above both of the developing unit 100 and the toner supply unit 110 and arrives at an area where an image is formed on the photoreceptor drum 6 through exposure.

When replacing developer contained in the developing unit 100 of the developing device 10 on the occasion of maintenance or the like, procedures therefor are as follows.

As shown in FIG. 1, photoreceptor drum 6, charging electrode 7, charge-elimination LED 8, developing unit 10, separation claw 13 and cleaning unit 14 are provided on a frame to constitute a unitized image process unit. The process unit is supported on rack rails 19A and 19B in a manner that it can be drawn out of the main body of a copying machine.

(1) First, a handle of a drum rack is pulled so that the drum rack may be drawn out of the main body of the copying machine to the predetermined position toward an operator to be removed.

(2) Casing 111 of toner supply unit 110 that covers opening 101A of casing 101 is caused to swing so that the opening 101A can be opened (see FIG. 3), and total amount of developer contained in the developing unit 100 is discharged through the opening mentioned above.

(3) Next, fresh developer is poured through the opening of the developing unit 100. In this case, developer falls on main agitating member 103 without touching developing roller 102 directly on the occasion of pouring developer because the brush-height-regulating plate 105 has a U-shaped section. The developer does not fall directly on auxiliary agitating member 104 or on toner concentration detection sensor 106 either.

(4) After that, when toner supply unit 110 is caused to swing, circular arc concave curved surface 111B of the casing 111 slides on circular arc convex curved surface 101C of guide wall 101B on the casing 101. After the sliding has been stepped, when the toner supply unit 110 is fixed to the developing unit 100 by means of clamping screw 119, the opening 101A is sealed hermetically through elastic pads 108 and 118.

(5) The process unit the is returned again to the predetermined position in the main body of the copying machine makes it possible to start copying again.

Incidentally, when no developer is contained in the developing unit 100 in the case of installation of a copying machine, procedures start from Item (3) in the above-mentioned procedures.

In the developing device explained above referring to the examples, a supply unit through which developer is poured to be supplied is one for using two-component developers. However, the supply unit for developer can be applied also to a developing device employing single-component developers.

For supplying a fresh developer into a developing unit in a developing device of the invention, when a toner supply unit is caused to swing, an opening located at the upper portion of the developing unit is made to be in its opened state. Therefore, a fresh toner poured onto a main agitating member of the developing unit directly through the opening can be contained in the developing unit surely without flowing out or scattering. Accordingly, it is possible to supply developers easily, quickly and surely without necessity of separating and attaching the toner supply unit. And, it is easy to discharge developer from the opening.

What is claimed is:

1. An apparatus for developing a latent image on a photoreceptor into a toner image comprising:

a conveyor for conveying developer to said photoreceptor;

a conveyor housing in which said conveyor is located and said developer is stored, said conveyor housing having at least one opening;

a toner housing in which a toner supplier is located and toner is stored, said toner housing next to one side of said conveyor housing and adapted to pivot about a pivotal support between a first position and a second position; in said first position, said toner housing engages said side of said conveyor housing whereby said toner housing prevents access to said opening from outside said conveyor housing, and in said second position, said toner housing is spaced apart from said conveyor housing whereby said opening is accessible from outside said conveyor housing, said opening being adapted to discharge said developer from said conveyor housing or pass fresh developer into said conveyor housing, ceiling portions of both said conveyor housing and said toner housing form substantially a flat surface, an exposure device adapted to expose said photoreceptor by an image light, wherein said flat surface of said ceiling portions is a passage for said image light.

2. An apparatus for developing a latent image on a photoreceptor into a toner image, said apparatus comprising;

a conveyor for conveying developer including toner to said photoreceptor;

a conveyor housing in which said conveyor is located and said developer is stored, said conveyor housing having a ceiling plate provided with a first opening;

a toner housing in which a toner supplier is located and toner is stored, said toner housing being arranged next to one side of said conveyor housing and having, at a lower portion thereof, a pivotal support about which said toner housing pivots between a first position comprising a toner feeding position in which toner is fed from said toner housing to said conveyor housing, and a second position comprising an inoperative position in which toner cannot be fed, said toner housing having a first side wall and a second side wall opposite to said first side wall, wherein, in said first position said first side wall adjoins said side of said conveyor housing and a pivot motion space is provided at an outside of said second side wall and, in said second position, said first side wall is spaced apart from said side of said conveyor housing, said second side wall is pivoted downwardly from its position in said first position into said pivot motion space and said lower portion of said toner housing is kept at substantially the same level as in said first position;

said toner housing including;

a toner feeding section in which a toner feeder is located, said toner feeding section being fixed to an upper portion of said first side wall of said toner housing, wherein said toner feeding section is pivoted together with said toner housing about said pivotal support and toner is supplied by said toner supplier into said toner feeding section, said toner feeding section having a floor plate provided with a second opening and being positioned above said conveyor housing in said first position so that said floor plate covers said ceiling plate and said second opening is aligned with said first opening, thereby preventing access to said first opening from outside of said conveyor housing and said toner housing and toner is dropped from said toner feeding section into said conveyor housing through said first opening and second opening; in said second position of said toner housing, said floor plate of said toner feeding section is spaced apart from said ceiling plate of said conveyor housing, wherein said first opening is accessible from outside of said conveyor housing and said toner housing, and said first opening is adapted to discharge said developer from said conveyor housing or pass fresh developer into said conveyor housing.

3. The apparatus of claim 2 wherein said pivotal support comprises a pair of pivot members in contact with a front wall and a rear wall of said toner housing.

4. The apparatus of claim 3 wherein said toner housing detachably engages said pivotal support.

5. The apparatus of claim 2 wherein said toner housing is substantially at a same level as said conveyor housing.

6. The apparatus of claim 2 wherein ceiling portions of both said conveyor housing and said toner housing form substantially a flat surface.

7. The apparatus of claim 2 wherein said toner feeder is a rotatable member disposed in said second opening and which, by its rotation, causes said toner to drop through said second opening into said conveyor housing.

8. The apparatus of claim 2 wherein said toner housing is disengaged from said pivotal support in said second position.

9. The apparatus of claim 8 wherein said toner housing is locked in said first position so as not to be disengaged from said pivotal support.

* * * * *